United States Patent [19]

Oyama et al.

[11] Patent Number: 4,845,458

[45] Date of Patent: Jul. 4, 1989

[54] COMPONENT ASSEMBLY FOR ELECTRICAL PART

[76] Inventors: Akira Oyama, 38-3 Aza-Koyachi, Maeyachi, Kanan-cho, Monou-gun, Miyagi-ken; Junichi Kuratani, 43-1 Aza-Kuwanoki Ara, Wakuya-cho, Toda-gun, Miyagi-ken, both of Japan

[21] Appl. No.: 172,954

[22] Filed: Mar. 17, 1988

Related U.S. Application Data

[62] Division of Ser. No. 7,614, Jan. 28, 1987, abandoned.

[30] Foreign Application Priority Data

Apr. 21, 1986 [JP] Japan ..... 61-90011

[51] Int. Cl.[4] ..... H01C 10/16

[52] U.S. Cl. ..... 338/132; 338/133; 338/162; 29/610.1

[58] Field of Search ..... 29/610 R, 613, 620, 29/621; 338/162, 163, 161, 128, 130, 132, 134

[56] References Cited

U.S. PATENT DOCUMENTS 4,334,352 6/1982 Van Benthuysen ..... 29/620

4,429,297 1/1984 Nakatsu ..... 338/162

*Primary Examiner*—E. A. Goldberg

*Assistant Examiner*—M. M. Lateef

*Attorney, Agent, or Firm*—Guy W. Shoup

[57] ABSTRACT

A component assembly, for constituting an electrical part such a volume unit, comprises a pair of appropriate components, such as those approximate to each other in electrical characteristic, joined as a unit by a connecting plate. In use, the pair of components are separated by severing the connecting plate and are then coupled together to provide the electrical part.

4 Claims, 2 Drawing Sheets

COMPONENT ASSEMBLY FOR ELECTRICAL PART

This is a divisional application of application Ser. No. 007,614 filed Jan. 28, 1987, now abandoned.

BACKGROUND OF THE INVENTION

1. Field of the Invention

The present invention relates to a component assembly for constituting an electrical (electronical) part, and more paricularly to such a component assembly in which a pair of components constituting a volume unit, for example, are such that electrical characteristics of their resistors are substantially equal.

2. Description of the Prior Art

In a volume unit, for example, slide contacts and slides on a pair of oppositely disposed resistors control volume of sound.

FIG. 5 of the accompanying drawing shows a volume unit 30 as a part of an electrical apparatus. In this volume unit 30, a pair of resistors are oppositely disposed within a pair of components 31, 31, between which resistors a slide (not shown) is disposed so as to be clamped thereby. By turning a shaft 33, the slide slides on these two resistors to thereby control the volume. It is preferable that the pair of opposed resistors have respective electrical characteristics as approximate to each other as possible.

In the manufacture of the volume unit of FIG. 5, a multiplicity of resistors are formed on an insulating base of relatively large area such as by printing. Then frames are formed of synthetic resin for respective resistors, and severed into individual components. Finally these components are combined to form a unified part as shown in FIG. 5. Practically, however, due to the staggered printed position of the resistors on the base, the difference in thickness of the resistors and the displacement of the base during its removal from the mold, it was difficult to impart quite the same electrical characteristic to the individual resistors. Therefore, in relatively large part, a mechanism is provided for controlling the mounting position of the slide in order to cope with the difference in electrical characteristic. On the other hand, since it is difficult to incorporate such control mechanism in a small electrical part, the components instead have to be chosen out of a large number of components to have a nearly identical electrical characteristic.

In the manufacture of small electrical parts, however, it is not easy to chose appropriate components of similar electrical characteristic out of a large number of components formed concurrently, which is laborious and time-consuming. Yet, even if a pair of appropriate components could be chosen, there is a possibility that the components can be coupled with wrong mating components of different characteristic in error during the stage of assembling.

SUMMARY OF THE INVENTION

It is therefore an object of the present invention to provide a component assembly of an electrical part in which assembly a pair of components of similar electrical characteristics are formed as a unit. With this component assembly, easy and precise assembling of particular parts can be achieved, thus enabling economical production of highly reliable electrical parts.

According to the present invention a component assembly, for constituting an electrical part such as a volume unit, comprises a pair of appropriate components approximate to each other in electrical characteristic, joined as a unit by a connecting plate. In use, the pair of components are separated by severing the connecting plate and are then coupled together to provide the electrical part.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
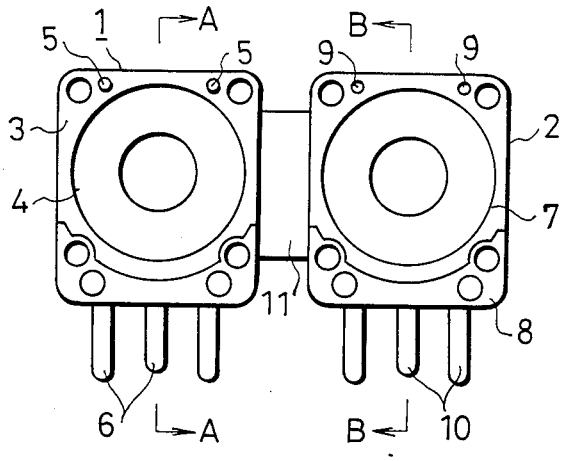
FIG. 1 is a front elevational view of a component assembly, for an electrical part, embodying the present invention.
Figure 2:
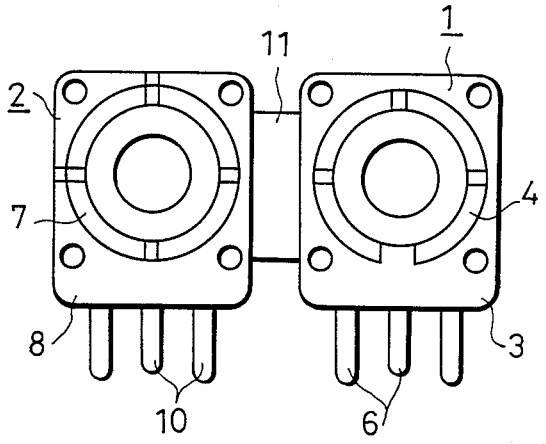
FIG. 2 is a rear elevational view of FIG. 1.
Figure 3:
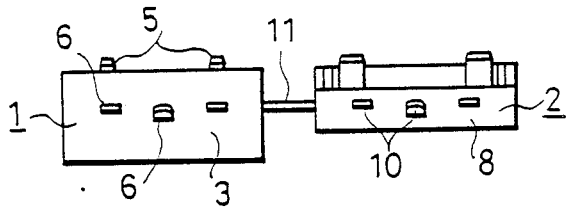
FIG. 3 is a bottom view of FIG. 1.
Figures 4A, 4B:
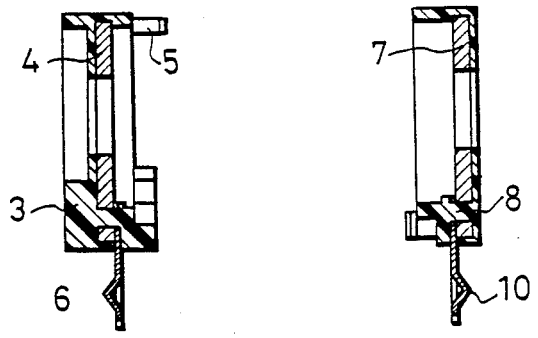
FIG. 4(A) is a cross-sectional view taken along line A—A of FIG. 1.
FIG. 4(B) is a cross-sectional view taken along line B—B of FIG. 1.
Figure 5:
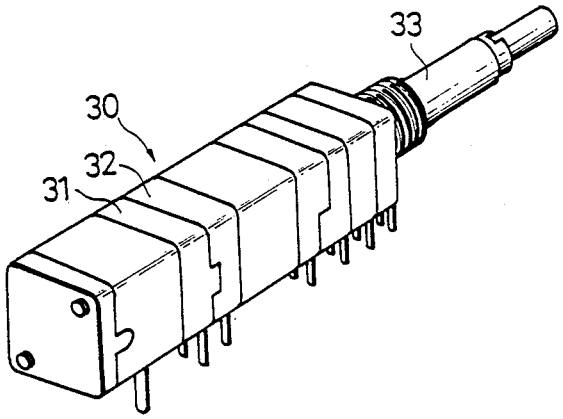
PRIOR ART Fig. 5
FIG. 5 is a perspective view of an electrical part.

FIGS. 1–3, 4(A) and 4(B) illustrate a component assembly for constituting an electrical part, i.e. a volume unit.

The component assembly comprises a pair of front and rear components 1, 2 interconnected so as to be disposed opposite to each other. The front component 1 includes a base 4 on which a resistor is formed, and a frame 3 formed of synthetic resin integrally with the base 4 in such a manner that the base 4 is disposed centrally of the frame 3. The frame 3 has a pair of projections 5, 5 formed thereon. Designated by the numeral 6 are terminals.

The rear component 2, like the front component 1, includes a base 7 on which a resistor is formed and a frame 8 formed integrally with the base 7 in such a manner that the base 7 is disposed centrally of the frame 8. The resistor formed on the base 7 is approximate, in electrical characteristic, to the resistor formed on the base 4. For instance, if a multiplicity of resistors are formed on the individual base which is large in size, the adjacent resistors which are similar in their forming condition may be chosen as a pair. But if they are similar in electrical characteristic, it is of course not essential that the pair of resistors are chosen from adjacent ones. The frame 8 has a pair of recesses 9, 9 in which the pair of projections 5, 5 formed on the frame 3 are to be inserted, respectively. Designated by the numeral 10 are terminals.

As mentioned above, the front and rear components 1, 2 each unified with the respective frame 3, 8 are joined as a unit by means of a connecting plate 11. Usually, however, the frame 3, the frame 8 and the connecting plate 11 are integrally formed by molding, rather than connecting the front and rear components 1, 2 being by the connecting plate 11 after these components have been formed independently.

For assembling a part, the connecting plate 11 is severed to separate the front and rear components 1, 2. Then the separated front and rear components 1, 2 are positioned in confronting relation, and a slide (not shown) is mounted between the two components 1, 2 for sliding (rotary) movement on their respective resistors. With the slide mounted between the two components 1, 2, the projections 5, 5 formed on the frame 3 of the front component 1 is inserted into the respective recesses 9, 9 formed in the frame 8 of the rear component 2, whereupon the front and rear components 1, 2 are fixedly secured. With this arrangement, it is possible to easily produce a volume unit from a pair of resistors which are similar in electrical characteristic.

Preferably, each frame 3, 8 may be 0.3–0.5 mm thick if its one side is 5–10 mm length, for example, so that the connector plate 11 can be relatively easily removed from the front and rear components 1, 2.

According to the present invention, since a pair of appropriate components, such as those similar in electrical characteristic, are joined as a unit by the connecting plate, easy and precise unification of predetermined components can be obtained upon assembling of a part, thus enabling economical production of highly reliable electrical parts.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of assembling an electrical part having a pair of resistor components controlled by a single shaft with sliding contacts thereon each contacting a respective one of the resistors, comprising the steps of:

making a pair of similar resistor components each having a base on which a resistor surface is to be formed and a frame formed integrally with the base, wherein the frames of the pair of similar resistor components are joined together by a connecting plate;

forming their resistor surfaces under similar conditions with the frames joined together so that the resistor surfaces have similar electrical characteristics;

severing the connecting plate; and assembling the separated, similar resistor components having similar electrical characteristics as the resistor components for the electrical part, whereby operation of the shaft can result in a similar response from each of the assembled pair of resistor components.

2. A method of component assembly according to claim 1, wherein each said frame is integrally formed with said base in such a manner that said resistor of said base is disposed centrally of each said frame.

3. A method of component assembly according to claim 1, wherein one of said pair of components has at least one projection formed on said frame, while the other component has in said frame at least one recess in which said at least one projection is to be inserted for coupling said separated components together.

4. A method of component assembly according to claim 1, wherein said frames of said pair of components and said connecting plate are integrally formed by molding.

* * * * *

UNITED STATES PATENT AND TRADEMARK OFFICE

CERTIFICATE OF CORRECTION

PATENT NO. : 4,845,458

DATED : July 4, 1989

INVENTOR(S) : Akira Oyama et al.

It is certified that error appears in the above-identified patent and that said Letters Patent is hereby corrected as shown below:

On the title page:

Alps Electric Co., Ltd. not listed as assignee.

Signed and Sealed this

Twenty-fifth Day of September, 1990

*Attest:*

HARRY F. MANBECK, JR.

*Attesting Officer*

*Commissioner of Patents and Trademarks*